United States Patent [19]

McQuay

[11] 4,339,630

[45] Jul. 13, 1982

[54] BUSHING DESIGN WITH CRIMPED ADAPTER FOR RETAINING CONDUCTOR

[75] Inventor: Edgar E. McQuay, Conover, N.C.

[73] Assignee: General Electric Company, Philadelphia, Pa.

[21] Appl. No.: 271,203

[22] Filed: Jun. 8, 1981

[51] Int. Cl.[3] ..... H01B 17/26

[52] U.S. Cl. ..... 174/152 R; 174/202

[58] Field of Search ..... 174/31 R, 152 R, 153 R, 174/167, 193, 202

*Primary Examiner*—Laramie E. Askin

*Attorney, Agent, or Firm*—William Freedman; John P. McMahon

[57] ABSTRACT

An adapter for retaining a conductive rod within a high voltage bushing insulator is disclosed. The adapter is crimped onto parallel slots of the conductive rod and located within a cavity of the insulator. The crimped adapter prevents radial, axial, and angular movement of the conductive rod relative to the insulator.

3 Claims, 6 Drawing Figures

BUSHING DESIGN WITH CRIMPED ADAPTER FOR RETAINING CONDUCTOR

BACKGROUND OF THE INVENTION

This invention relates to a high voltage bushing insulator, and, more particularly, this invention relates to an adapter for an insulator for retaining a conductive rod within an internal cavity of the insulator.

The high voltage bushing typically comprises an insulator formed of an insulating material which encloses a conductive rod. The conductive rod provides the means for interconnecting two branches of a high voltage network. The conductive rod is positioned in a fixed relationship with respect to the insulator. The conductive rod is typically mated with an adapter which retains the conductive rod within the confines of the insulator in its axial, radial, and angular directions. The insulator is typically provided with a cavity for locating and retaining the adapter.

The adapter typically comprises an annular shaped device for positioning within the cavity, a spring for supplying tension for holding the annular device within the confines of the cavity, and two pins positioned into two drilled-out holes of the conductive rod to confine the movement of the adapter to the conductive rod. A high voltage bushing such as previously described having a cavity and an adapter comprised of the annular device, a spring and two pins is available from the Distribution Transformer Department of the General Electric Company, Hickory, N.C., as its standard pole type high voltage cover bushing. The adapter of the standard high voltage cover bushing has fabrication disadvantages in that it requires a three parts arrangement and also has a disadvantage in that the three piece arrangement must be manipulated during initial assembly and field replacement.

Accordingly, it is an object of the present invention to provide a one-piece adapter means for retaining the conductive rod within the high voltage bushing insulator which is easily assembled and disassembled to accommodate initial fabrication and field replacement.

It is another object of the present invention to provide an adapter means that is easily assembled onto the conductive rod.

These and other objects of the invention will become apparent to those skilled in the art upon consideration of the following description of the invention.

SUMMARY OF THE INVENTION

The present invention is directed to a high voltage bushing having an adapter for interconnecting the insulator portion of the high voltage bushing to a conductive rod.

In accordance with one embodiment of the invention, a high voltage bushing comprising a tubular insulator formed of an insulating material and having a central passageway extending through the length of the insulator is provided. The insulator has an upper portion with a cavity which is formed in part by the passageway. The cavity has a lower retaining portion and an upper entrance portion. The entrance portion is constituted by the upper region of the passageway and has a first and a second entrance groove extending longitudinally along the passageway. The retaining portion comprises two locking grooves extending partially around the passageway and communicating with the first and second entrance grooves. The high voltage bushing further comprises a conductive rod within the passageway having a length greater than the length of the insulator. The conductive rod has notches at its laterally opposed sides and at a predetermined location along its length. The conductive rod has means at one end adapted to couple the rod to electrical apparatus. A cap at the other end of the conductive rod is adapted to connect the rod to a high voltage power source. Means at the other end of the rod couple the rod to the cap. The bushing further comprises a retaining means effective when operable to hold the rod against axial, radial, and angular movements within the passageway. The retaining means comprises a generally disc-shaped metallic adapter having a central opening receiving the rod and edge portions adjacent the central opening that are located in the notches in the rod. The adapter is crimped about the rod so that the edge portions tightly grip the rod at the notches. The opening in the adapter before crimping is sufficiently large to allow the adapter to be slipped over one end of the rod into a position of alignment with the notches and thereafter crimped. The adapter has projecting ears on its outer periphery which can be slid within the entrance grooves and into said locking grooves. The ears are located within said grooves in positions angularly displaced from the entrance grooves when said retaining means is operable.

The features of the invention believed to be novel are set forth with particularity in the appended claims. The invention itself, however, both as to its organization and operation, together with further objects and advantages thereof, may best be understood by reference to the following description, taken in conjunction with the accompanying drawings.

DETAILED DESCRIPTION OF THE PREFERRED EMBODIMENT

Figure 1:
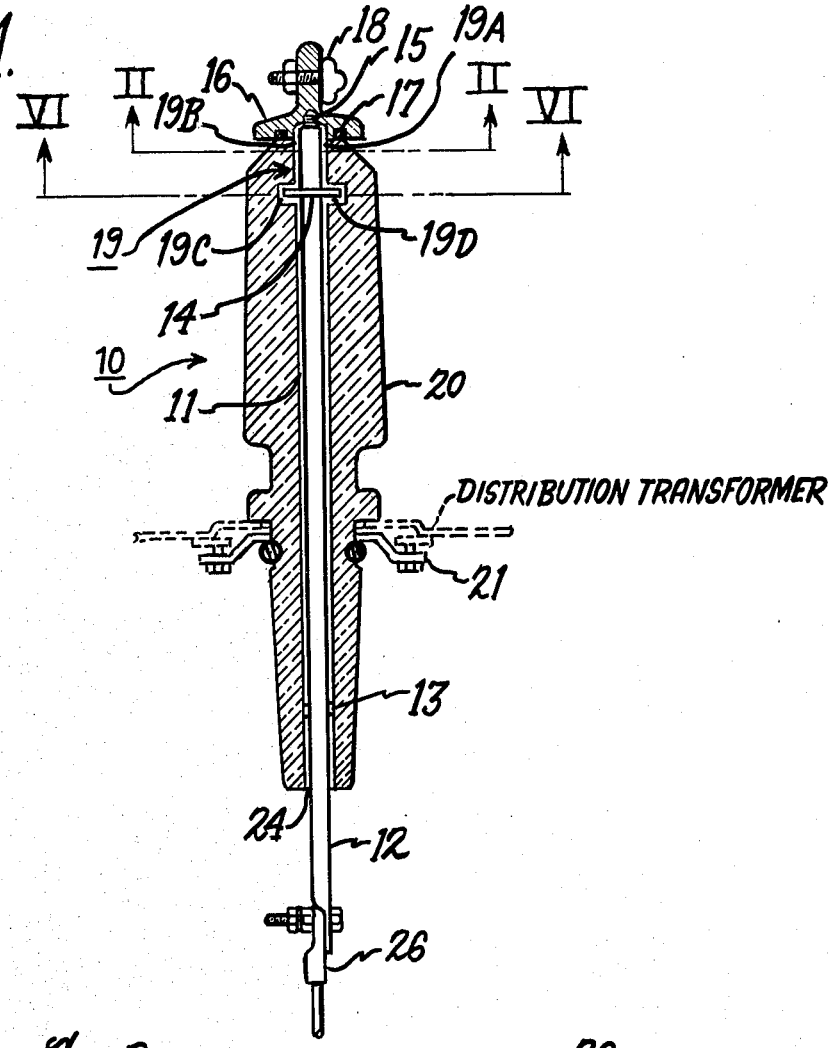
FIG. 1 shows a high voltage bushing in accordance with one embodiment of the present invention.

FIG. 1 shows a cross-sectional view of a high voltage bushing 10 used with a pole-type distribution transformer (not shown) of a high power network. The high voltage bushing 10 has a first connecting means 26 interconnected by suitable means to a flat portion of a conductive rod 12 of the high voltage bushing 10 and a second connection means 18 extending into an opening of a cap 16 of the high voltage bushing 10. The cap 16 is interconnected to the conductive rod 12 by an inner-screw arrangement 15 which is adapted to receive a threaded end portion of the conductive rod 12. The first and second connecting means 26 and 18, respectively, are used to interconnect the high voltage bushing 10 to the one side of a transformer high voltage winding and to a high voltage power source. The high voltage bushing 10 has a thread connecting means 21 for mounting the high voltage bushing 10 to the distribution transformer. The distribution transformer is not considered part of this invention and will not be further described.

The high voltage bushing 10 has an insulator 20 having an elongated-tubular shape, as shown in FIG. 1, and is comprised of an insulating material such as porcelain. The insulator 20 of the high voltage bushing 10 has an inner passageway 11 that longitudinally extends throughout the length of the high voltage bushing. The passageway 11 is typically provided with a collar 13 for centering the conductive rod 12 within the hollow 11.

The passageway 11 is comprised of an opening 24 that longitudinally extends throughout the passageway 11 and a cavity 19 occupying a minor portion, shown in FIG. 1 as the upper region of bushing 10, of the passageway 11. The passageway 11 provides the means for entering and inserting the conductive rod 12 into the insulator 20 and also provides, in part, the means for retaining the conductive rod 12 within the confines of the insulator 20. The portion of the passageway 11 for retaining the conductive rod 12 is the cavity 19.

Figure 6:
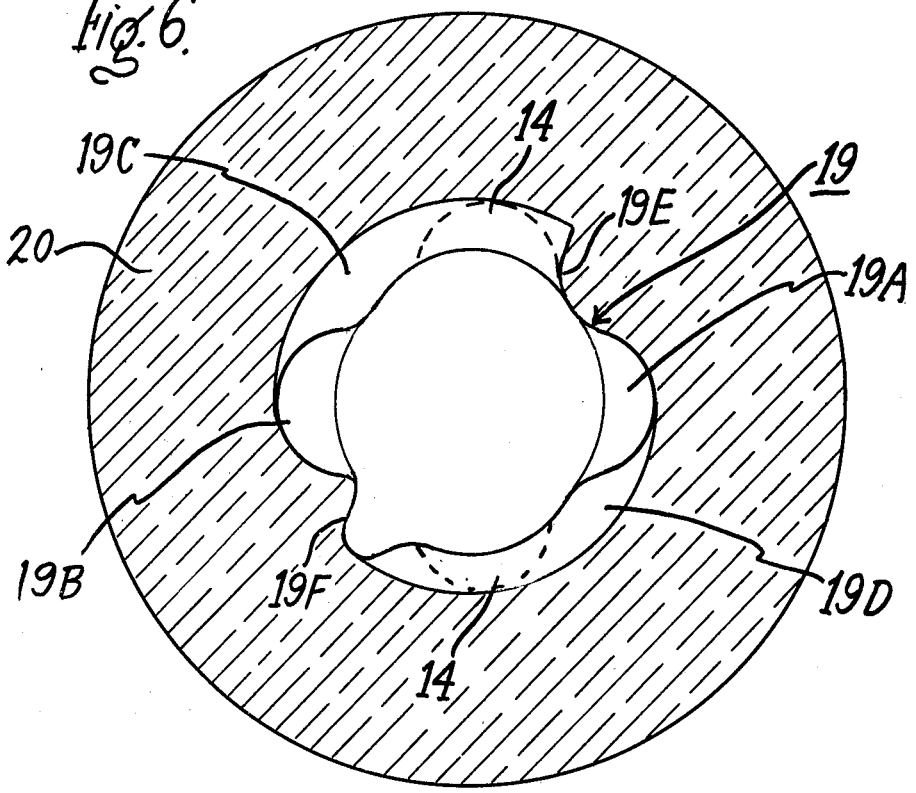
FIG. 6 is a cross-sectional view along lines VI—VI of FIG. 1 showing the retaining portion of the high voltage bushing.

The cavity 19 has entrance grooves 19A and 19B, and a first and a second locking groove 19C and 19D. The entrance grooves 19A and 19B of cavity 19 are shown most clearly in FIG. 2 which is a cross-sectional view of the insulator 20 taken along lines II—II of FIG. 1, whereas, the locking grooves 19C and 19D are shown in FIG. 6. The entrance grooves 19A and 19B constitute the upper region of the passageway 11. As will be described hereinafter, the dimension of cavity 19, the dimensions of an adapter 14 mating to conductive rod 12, and the location of notches 66B and 66C shown in FIG. 3, are interrelated so that conductive rod 12 is axially, radially, and angularly fixed relative to the insulator 20. The adapter 14 is shown most clearly in FIG. 3.

The dimensions of the adapter 14, to be given hereinafter, are relative to a horizontal center line 54 and a vertical center line 30 both shown in FIG. 3. The adapter 14 is a genrally disc-shaped device and is mainly comprised of an inner hollow 35 and bowed-out outer structure 45. The adapter 14 is comprised of a rolled steel type material such as low carbon cold rolled steel AISI 1010.

The inner hollow 35 is comprised of a central portion 35A and two outer portions 35B and 35C. The central portion 35A has a generally rectangular shape whereas the outer portions 35B and 35C have a circular-peaked elongated shaped configuration.

The outer portions 35B and 35C have a bowed out shape having a radius of curvature 42. It should be noted from FIG. 3 that the central portion 35A and outer portions 35B and 35C are formed by smooth circular shaped boundaries having a radius of curvature 48. Still further, the side portions of the walls of central portion 35 have a curved surface having a radius of curvature 52. It should be further noted from FIG. 3 that all the walls of the inner hollow 35 have a rounded-type shape. The rounded-type shape of the walls of the inner hollow 35 allow the inner portion 35 to smoothly move along the conductive rod 12 during the crimping operation, to be described hereinafter, of adapter 14 to the conductive rod 12.

The central portion 35A has a width 32A and height 41. The outer portions 35B and 35C have widths 32B and 32C, respectively. Each of the outer portions 35B and 35C has a height 40. The combined width of inner hollow 35 has a dimension 32 which is the combined width of 32A, 32B, and 32C.

The bowed-out outer structure 45 is similar to the inner hollow 35 in that it is comprised of a central portion 45A, and two outer portions 45B and 45C. From FIG. 3, it should be noted that structure 45 has four bowed-out protrusions, two mainly related to central portion 45A and two respectively related to outer portions 45B and 45C. Still further, from FIG. 3 it should be noted that the bowed out protrusions related to outer portions 45B and 45C provide the outer periphery of adapter 14 with a shape resembling that of projecting ears. The four bowed-out protrusions of structure 45 are formed together by an inwardly contoured valley having a radius of curvature 50. The bowed-out protrusions related to the central portion 45A has a radius of curvature 46 whereas the bowed-out protrusions related to outer portions 45B and 45C have a radius of curvature 44. The bowed-out structure 45 of adapter 14 has an overall horizontal dimension 34 and a vertical dimension 36 as shown in FIG. 3. The dimensions of adapter 14 are selected so as to be retained within cavity 19 of insulator 20 and allowed to receive and be mated with the conductive rod 12 shown most clearly in FIG. 4.

Figure 3:
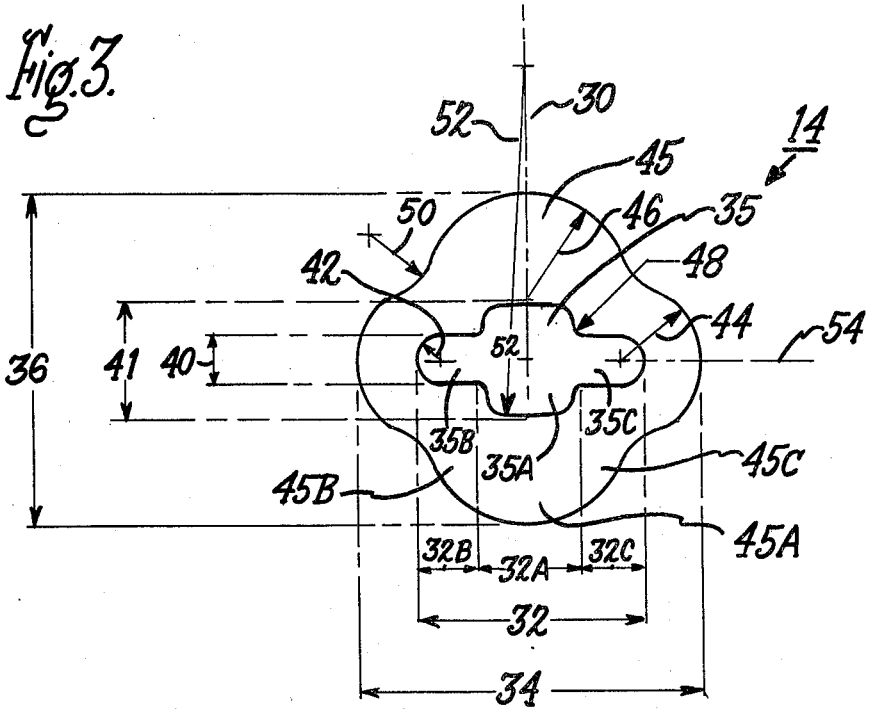
FIG. 3 shows the retaining means of the present invention.
Figure 4:
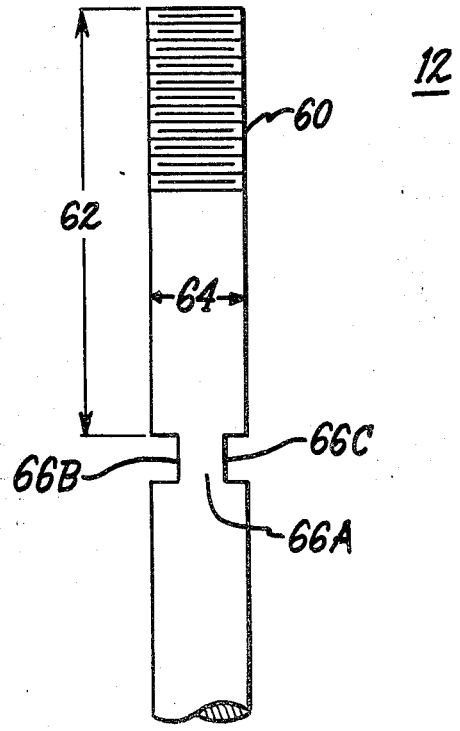
FIG. 4 shows a portion of a conductive rod adapted to receive the retaining means of FIG. 3.

FIG. 4 shows a portion of the conductive rod 12 as having a thread-type arrangement 60 located on one of its ends, which as previously mentioned threads into the cap 16 of the high voltage bushing 10. The conductive rod 12 has a diameter 64 and a pair of notches 66B and 66C each located a predetermined distance 62 from the top of conductive rod 12. The notches 66B and 66C are located on laterally opposed sides of the conductive rod 12. The conductive rod 12 has a predetermined diameter 64. The notches 66B and 66C form a region 66A of conductive rod 12, about which the adapter 14 is mated. The notches 66B and 66C have a height corresponding to the thickness selected for adapter 14, whereas the region 66A has a width corresponding to the dimensions selected for the central portion 35A of adapter 14. The dimensions of inner hollow 35 are selected so as to slide over and position into the notches 66B and 66C. The dimensions of adapter 14 are selected in accordance with diameter 64 of conductive rod 12, which, in turn, is selected in accordance with the material comprising conductive rod 12 and the amount of current required to be conducted by conductive rod 12. Conductive rod 12 is preferably formed of a steel material although other types of conductive material, such as aluminum or copper may be used. The dimensions of adapter 14, shown in FIG. 3, and having a thickness of 4.0 mm relative to notches 66B and 66C related to a conductive rod 12 formed of a steel material having a diameter 64 equal to 8.4 mm and capable of conducting a current of 50 amperes, are given in Table 1.

TABLE 1

| Dimensions of Adapter 14 | |
|---|---|
| 32 - 18.3mm | 41 - 8.6mm |
| 32A - 7.1mm | 42 - 2.3mm |
| 32B - 5.6mm | 44 - 6.6mm |
| 32C - 5.6mm | 46 - 8.6mm |
| 34 - 27.9mm | 48 - 0.5mm |
| 36 - 26.9mm | 50 - 5.1mm |
| 40 - 4.6mm | 52 - 25.4mm |

The dimensions given in Table 1 are further related to the crimping deformation of adapter 14 after it has been located into notches 66B and 66C. For example, the application of an adequate crimping force causes dimension 36 to decrease from 26.9 mm to 22.9 mm and further causes dimension 34 to increase from 27.9 mm to 30.5 mm. These changes to dimensions 34 and 36 cause the adapter 14 to be flush fitted and affixed into the notches 66B and 66C of conductive rod 12.

Figure 5:
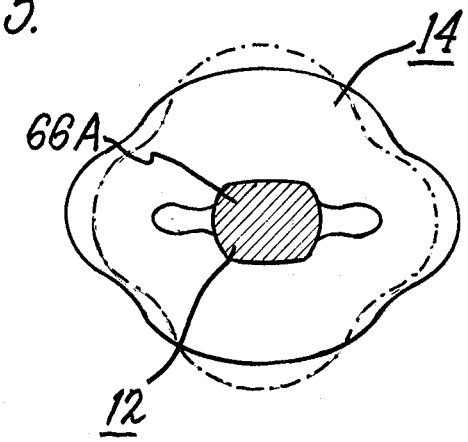
FIG. 5 shows the retaining means of FIG. 3 crimped about the conductive rod of FIG. 4.

The adapter 14 after receiving an adequate crimping force is shown in its deformed shape about the region 66A of the conductive rod 12 in FIG. 5. From FIG. 5 it should be noted that adapter 14 is crimped about the region 66A of the conductive rod 12. The crimping causes the adapter 14 to tightly grip the conductive rod 12 at the notches 66B and 66C.

Figure 2:
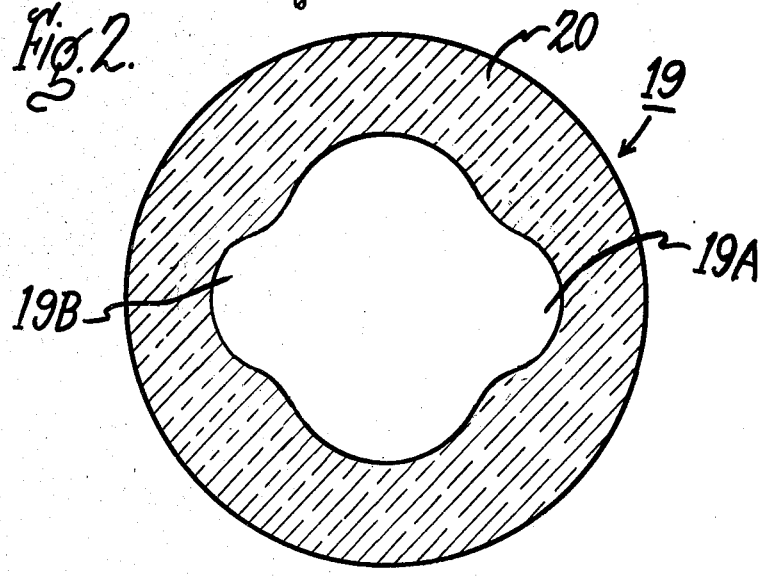
FIG. 2 is a cross-sectional view along lines II—II of FIG. 1 showing the entrance portion of the high voltage bushing.

Still further, the dimensions given in Table 1, and shape of the crimped adapter 14 shown in FIG. 5, are further related to the dimensions and shape of the insulator 20, more particularly, the cavity 19 of the insulator 20 shown in previously discussed FIGS. 1 and 2 and in FIG. 6 to be described.

The tubular insulator 20 of FIG. 1 and the cavity 9 shown in FIGS. 1, 2 and 6 have dimensions of that of the aforementioned high voltage bushing commercially available from the General Electric Company as their standard pole type high voltage cover bushing. The entrance grooves 19A and 19B of cavity 19 shown in FIG. 2, have a shape similar to that of adapter 14 and corresponding dimensions slightly greater than that of adapter 14. The dimensions of entrance grooves 19A and 19B being greater than adapter 14 allow the adapter 14 to be inserted into the passageway 11 of the high voltage bushing.

As previously discussed, cavity 19 further comprises a first and second locking groove 19C and 19D, respectively, shown most clearly in FIG. 6. FIG. 6 is a sectional view of cavity 19 taken along lines VI—VI of FIG. 1. FIG. 6 shows the cavity 19 occupying the central portion of insulator 20 shown in cross section. FIG. 6 shows cavity 19 as having entrance grooves 19A and 19B and locking grooves 19C and 19D extending partially around the opening 24 of the passageway 11. The grooves 19A and 19B extend longitudinally along the cavity 19 and form the entrance portion of cavity 19 for inserting the crimped adapter 14. The locking grooves 19C and 19D form the retaining portions of cavity 19 for locking the position of the adapter 14 within the confines of cavity 19.

The projecting ears of the adapter 14 are shown in FIG. 6 in phantom positioned within the locking grooves 19C and 19D. The locking grooves 19C and 19D communicate with the entrance grooves 19A and 19B to allow the adapter 14 to be positioned in the cavity 19 as shown in FIG. 6. The adapter 14 enters into cavity 19 through the entrance grooves 19A and 19B and then the adapter 14 may be rotated in a clockwise direction until the adapter 14 abuts against portions of solid walls 19E and 19F of cavity 19 respectively related to locking grooves 19C and 19D. As shown in FIG. 6 the solid wall portions 19E and 19F are angularly displaced from each other. When adapter 14 abuts against the solid walls 19E and 19F, cavity 19 operates to hold the conductive rod 12, which is affixed to adapter 14, against axial, radial, and angular movements within the passageway 11.

It should now be appreciated that this invention provides a one-piece adapter 14 for retaining the conductive rod within the passageway 11 of the insulator 20. The adapter 14 is easily affixed to the conductive rod 12 by the simple application of a crimping force.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim is:

1. A high voltage bushing comprising a tubular insulator formed of an insulating material and having a central passageway extending through the length of the insulator, said insulator having an upper portion with a cavity which is formed in part by said passageway, said cavity having a lower retaining portion and an upper entrance portion, said entrance portion being constituted by the upper region of said passageway and having a first and a second entrance groove extending longitudinally along said passageway, said retaining portion comprising two locking gooves extending partially around said passageway and communicating with said first and second entrance grooves, said high voltage bushing further comprising a conductive rod within said passageway having a length greater than the length of said insulator, said conductive rod having notches at its laterally opposed sides and at a predetermined location along its length, means at one end of said conductive rod adapted to couple the rod to electrical apparatus, a cap at the other end of said conductive rod adapted to connect the rod to a high voltage power source, means at the other end of said rod for coupling said rod to said cap, the bushing further comprising;

retaining means effective when operable to hold said rod against axial, radial, and angular movements within said passageway, said retaining means comprising;

a generally disc-shaped metallic adapter having a central opening receiving said rod and edge portions adjacent said central opening that are located in said notches in the rod, said adapter being crimped about said rod so that said edge portions tightly grip the rod at the notches, said opening in the adapter before crimping being sufficiently large to allow said adapter to be slipped over one end of the rod into a position of alignment with said notches and thereafter crimped;

said adapter having projecting ears on its outer periphery which can be slid within said entrance grooves and into said locking grooves, said ears being located within said locking grooves in positions angularly displaced from said entrance grooves when said retaining means is operable.

2. The high voltage bushing of claim 1 in which said adapter opening has an elongated configuration and a relatively large width before being crimped, crimping acting to reduce said width and force said ears to project outwardly by a greater amount.

3. The high voltage bushing of claim 2 in which crimping forces said adapter into a shape which conforms more closely with the cross sectional configuration of said entrance portion.

* * * * *